United States Patent [19]

Bradley

[11] 4,204,345

[45] May 27, 1980

[54] SOCK

[76] Inventor: Virginia R. Bradley, 3444 Huntington Terrace, Crete, Ill. 60417

[21] Appl. No.: 856,286

[22] Filed: Dec. 1, 1977

Related U.S. Application Data

[63] Continuation-in-part of Ser. No. 726,680, Sep. 27, 1976, abandoned.

[51] Int. Cl.[2] ..... A43B 3/26; A43B 3/10

[52] U.S. Cl. ..... 36/97; 36/10

[58] Field of Search ..... 36/1, 10, 51, 7.1 R, 36/7.3, 97, 138; 2/239

[56] References Cited

U.S. PATENT DOCUMENTS

| | | | |
|---|---|---|---|
| 2,497,528 | 2/1950 | Baker | 36/10 |
| 2,952,926 | 9/1960 | Laren | 36/10 |
| 3,017,705 | 1/1962 | Peters | 36/7.3 |
| 3,618,235 | 11/1971 | Cary | 36/97 |
| 3,694,940 | 10/1972 | Stohr | 36/10 |
| 3,744,163 | 7/1973 | Simister | 36/97 |
| 3,824,714 | 7/1974 | Glassman | 36/7.1 R |

FOREIGN PATENT DOCUMENTS

| | | | |
|---|---|---|---|
| 2212136 | 9/1973 | Fed. Rep. of Germany | 36/7.3 |

*Primary Examiner*—Patrick D. Lawson
*Attorney, Agent, or Firm*—Robert D. Farkas

[57] ABSTRACT

A plastic sock that is adapted for use in combination with a boot or galosh for facilitating insertion of the foot therein and to keep the feet dry while the overboot is worn.

7 Claims, 4 Drawing Figures

SOCK

This is a continuation-in-part application of Ser. No. 726,680 filed on Sept. 27, 1976, and now abandoned.

BACKGROUND OF THE INVENTION

This invention relates to a plastic sock; more particularly to a plastic boot liner or sock to be worn either over one's own socks for insertion into a shoeless boot or over a shoe for use with a galosh.

The prior art teaches a variety of boot liners, socks and the like, for example, as disclosed in U.S. Pat. Nos. 1,644,217; 2,924,029; 3,358,188; 3,359,658; 3,605,291; 3,694,940; 3,824,714; 3,875,687; and others.

SUMMARY OF THE INVENTION

It is accordingly an object of the instant invention to provide for a new and improved means for maintaining the feet dry while wearing boots, facilitating insertion of the foot into an adjustable boot and a method therefor.

It is another object to provide for the same at relatively little cost thereby making the same generally available.

These and other objects and advantages of the invention will become more apparent from a consideration of the following detailed disclosure and claims and by reference to the accompanying drawings, in which:

Broadly speaking, the instant invention includes the provision of an adjustable tubular sock for use in combination with a boot comprising a liquid impermeable single sheet having a tubular configuration and one open end, the open end having a rim portion, the rim portion including means for receiving the sheet about the leg, the sheet being in contact with the inside surface of an outer boot.

DETAILED DISCLOSURE

Figure 1:
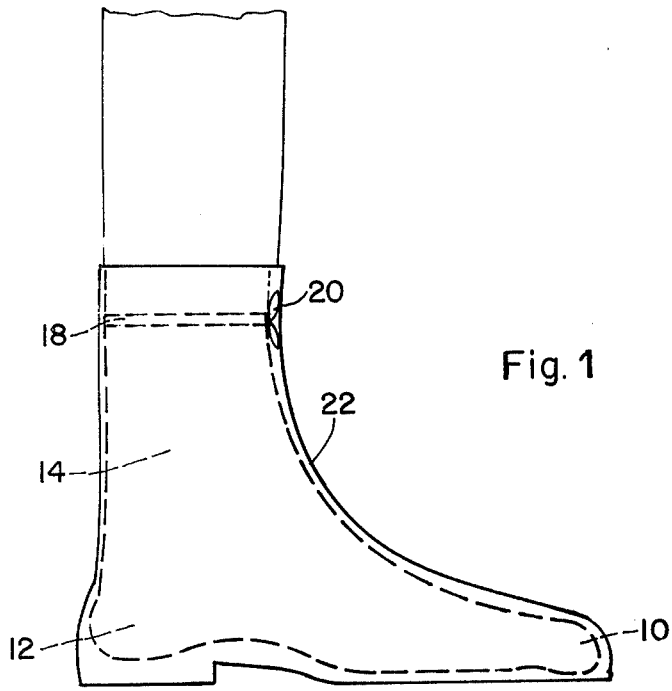
FIG. 1 is a side elevational view of one embodiment over the foot inside a shoe boot.
Figure 2:
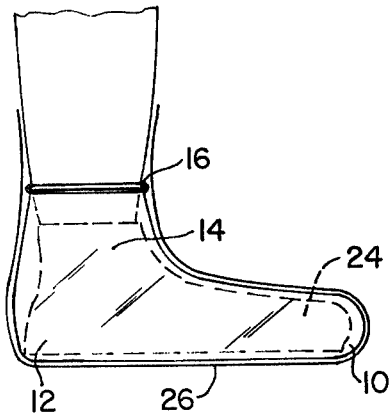
FIG. 2 is also a side elevational view of the invention worn over a shoe that is subsequently to be placed into an overboot.

Referring more particularly to the drawings, there is shown a liquid impermeable material that is shaped in the form of a unitary sock-like structure having a toe portion 10, heel portion 12, and upper portion 14. The sock-like structure is preferably made from a suitable plastic that is lightweight, flexible and preferably air permeable, i.e., polyethylene, polypropylene, urethane film, etc. The sock is so formed that an open end is provided for insertion of the foot with or without a shoe therethrough. The other end is closed. The open end has a rim portion that includes elastic means 16 therein, disposed either in an annular channel therein or bonded to one surface thereof, such as by water insoluble adhesive, heat sealed, etc. In another embodiment, an annular channel 18 has a string or band 20 therein that scores as a drawstring therefore, to effectively close the open end about the leg portion. In the embodiment shown in FIG. 1, the sock is worn over a pair of stockings and the foot is then inserted into a shoeless boot 22. In the embodiment shown in FIG. 2, the sock is worn over a shoe

24, the shoe thus covered then is placed inside a boot or galosh 26.

Figure 3:
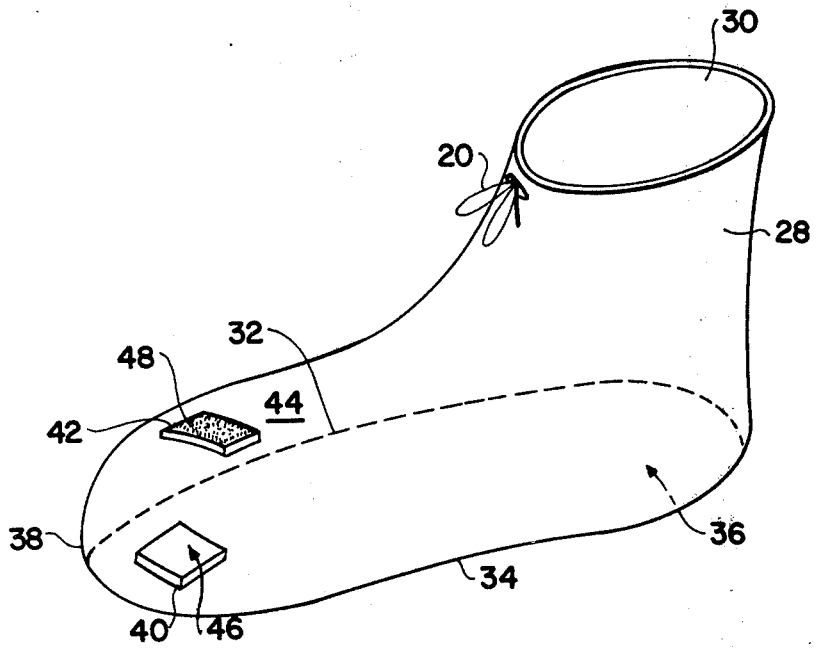
FIG. 3 is a perspective view of another embodiment of the present invention.

FIG. 3 illustrates a tubular sock-like device 28, having draw string 20 disposed adjacent foot receiving opening 30. Dotted lines 32, in combination with line 34, silhoette the outline of the sole portion 36 thereof. Adjacent toe region 38 and on sole portion 36, pad 40 is secured, by any convenient means, well known in the art. Pad 42 is similarly secured, utilizing the same or different securement means to the outside surface 44, adjacent toe region 38, and opposite sole region 36. When the exterior surface 46 of pad 40 and the exterior surface 48 of pad 42 contact each other, both pads are removably secured to each other. Such adherence is obtained by having either pad 40 or pad 42 fabricated from a pad having a plurality of elongated barb-like projections extending outwardly therefrom, and having the other of such pair of pads fabricated from a fabric-like material having a nap-like exposed surface. When the barb-like protrusions are engaged into the nap-like surface, a reasonable amount of force is required to dislodge the surfaces. Such securement is obtained by having pad 40 folded upwardly and forwardly of the toe region of a foot of a user, disposed into the interior of device 28, and thence allowing exterior surface 46 to contact exterior surface 48.

Figure 4:
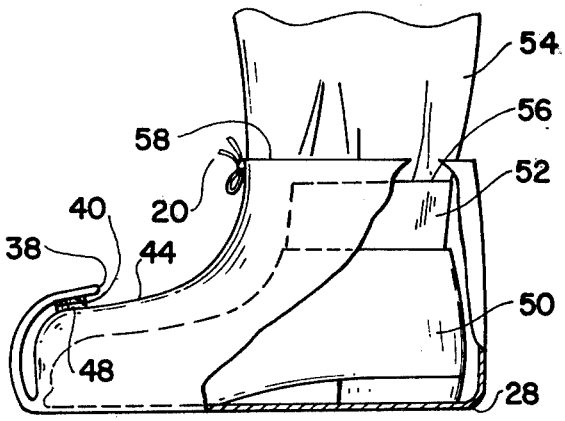
FIG. 4 is a perspective view of the embodiment shown in FIG. 3 being worn over a shoe boot.

FIG. 4 illustrates shoe 50 shown having leg portion 52, of a user, not shown, disposed therewithin. Trouser leg portion 54 is shown having the lowermost edge 56 thereof disposed beneath the uppermost edge 58 of embodiment 28. Toe portion 38 is shown in the folded up position residing over external surface 44, wherein pad 40 is in a superior position to pad 48. Thus, as shown, the length of article 28 is made adjustable so as to conform to the length of shoe 50 providing for a snug fit thereover. It should be specifically understood that though the apparatus described in FIGS. 3 and 4 herein is shown provided with a string-like element 20, elastic means 16, shown in FIG. 2, may be employed so as to secure the marginal edge 58, shown in FIG. 4, against the leg or trousers of a user. As is apparent from the foregoing, the instant means provide for facilitation of insertion of the feet into a boot.

Since it is obvious that numerous changes and modifications can be made in the above-described details without departing from the spirit and nature of the invention, it is to be understood that all such changes and modifications are included within the scope of the invention.

I claim:

1. A tubular sock for use in combination with a boot, comprising a unitary liquid impermeable sock member having a tubular seamless configuration and a closed end, one open end, said open end having a rim portion, the rim portion including means for securing said sock about the leg of a user, means to adjust the length of said sock by disposing said closed end in a foreshortened condition wherein said closed end is disposed overlapping a portion of said sock member adjacent said closed end when said closed end is in said foreshortened condition, said means for for adjusting the length including a first pad and a second pad, said first pad fixedly secured to the exterior surface of said sock adjacent at a region thereof disposed adjacent the toes of the user and opposite the sole thereof when the user's foot is engaged within said sock, said second pad being fixedly secured to said exterior surface of said sock adjacent the end opposite said open end, means to removably secure said first pad to said second pad, whereby said closed end of said sock member is disposed in a folded up configuration when said first pad is engaged to said second pad thereby disposing said sock member in said foreshortened condition, wherein said sock may be alternately disposed in contact with an inside surface and an outside surface of said boot.

2. The combination as defined in claim 1, wherein said means for securing is an elastic band, said rim including an annular channel, said elastic band being disposed in said channel.

3. The combination as defined in claim 1, wherein said means is a drawstring, said rim including an annular channel, said string disposed in said channel.

4. The combination as defined in claim 1, wherein said sheet contacts a shoe at one surface and the opposite surface thereof contacts said inner surface.

5. The combination as defined in claim 1, wherein the opposite surface of said sheet contacts a sock.

6. The combination as defined in claim 1 wherein said means for securing is an elastic band, said elastic band being fixedly secured to said sheet adjacent said rim.

7. The combination as defined in claim 1 wherein said means to removably secure comprises at least one of said first pad and said second pad having a plurality of bristles, said plurality of bristles having a barb-like configuration, the other of said first pad and said second pad having a nap-like surface for engaging said barb-like protrusions.

* * * * *